US005100148A

United States Patent [19]

Smith

[11] Patent Number: 5,100,148

[45] Date of Patent: Mar. 31, 1992

[54] GOLF PRACTICE APPARATUS

[76] Inventor: Jay A. Smith, 6109 E. Hwy. 80, Odessa, Tex. 79763

[21] Appl. No.: 713,190

[22] Filed: Jun. 10, 1991

[51] Int. Cl.[5] ..... A63B 69/36

[52] U.S. Cl. ..... 273/186 A; 482/109; 273/193 A

[58] Field of Search ..... 273/186 R, 186 A, 193 R, 273/193 A, 193 B, 194 R, 194 A, 194 B, 186 C, 183 D; 272/124

[56] References Cited

U.S. PATENT DOCUMENTS

| | | | |
|---|---|---|---|
| 2,739,414 | 3/1956 | Cleveland | 446/66 |
| 2,910,297 | 10/1959 | Bonetate | 273/186 A |
| 3,136,546 | 6/1964 | Connolly | 273/26 |
| 3,565,444 | 2/1971 | La Rocca | 273/186 A |
| 3,606,340 | 9/1971 | Tiller | 273/186 A |
| 3,809,397 | 5/1974 | Gruenewald | 273/26 B |
| 3,897,068 | 7/1975 | Staples | 273/186 A |
| 4,118,033 | 10/1978 | Miyamoto | 273/186 A |
| 4,330,121 | 5/1982 | McCafferty | 273/26 B |
| 4,576,378 | 3/1986 | Backus | 273/186 A |
| 4,878,673 | 11/1989 | Pollard | 273/186 C |
| 4,932,661 | 6/1990 | Choi | 273/186 A |
| 4,953,868 | 9/1990 | Thompson et al. | 273/186 A |

OTHER PUBLICATIONS

"Golf Digest", Mar. 1979, pp. 110 and 111.

*Primary Examiner*—George J. Marlo
*Attorney, Agent, or Firm*—Marcus L. Bates

[57] ABSTRACT

A golf practice and exercise apparatus has a shaft with a grip at one end and a variable drag device at the other end. The variable drag device has a main body with opposed edges. Several wings are attached to each of the edges in a manner to be easily removed from the apparatus. The shaft can be held in a golfer's hands and the practice device swung as in striking a golf ball with a golf club, whereupon air resistance of the drag device imparts a force into the golfer's body to improve muscle strength and coordination and to cause the golfer to assume an improved stance which will be remembered with practice.

18 Claims, 3 Drawing Sheets

GOLF PRACTICE APPARATUS

BACKGROUND OF THE DISCLOSURE

Millions of men, women and children in this world are avid golfers, and most of them are almost fanatical about playing golf just a bit better than their associates. Accordingly, they constantly strive to improve the technique that must be employed to hit the ball true and far.

The prior art illustrates numerous devices by which a golfer can enhance his playing technique, and while many of these devices do indeed improve the golfers' playing technique, they fail to teach one to assume the proper swing for striking the ball in a reasonable length of time. Moreover it is difficult to develop the appropriate muscles for striking the ball far and true with the presently available practice apparatus.

Often a golfer is unable to spare the time to travel to the golf course for practice or for a game of golf. At other times, inclement weather will preclude one from playing golf. During these intervals of time, it would be advantageous and more convenient for the golfer to be able to practice his swing technique in his own home or office.

The distance a golf ball travels after being struck with different golf clubs can vary, for example, from 0 to 300 yards. Hence, it is easy to see that a slight change in one's strength and swing technique could result in obtaining substantial additional yardage down the fairway. This is very important to a golfer because if he can progressively increase his hitting distance, it stands to reason that some day he will realize his maximum potential distance.

A golf swing practice and exercise apparatus by which the golfer can exercise to improve his hitting strength and at the same time improve his stance, swinging form and the distance he can hit a ball is the subject of the present invention.

SUMMARY OF THE INVENTION

This invention comprehends a golf practice and exercising apparatus by which a golfer can exercise his body in a manner to improve his golf playing technique. The apparatus comprises a shaft similar to a golf club shaft, having a hand grip at one end and a drag device at the other end so that when the hand grip is held by the golfer and the shaft swung as though it were a golf club, the drag device induces a force due to wind resistance. The drag device can produce a selected variable force by changing the configuration of the drag device.

The drag device includes a main body from which a plurality of wings extend. The wings are positioned on opposite sides of the shaft and are arranged to cause variable resistance with ambient, depending upon the configuration and surface area of the wings of the drag device.

Hence, the configuration and number of wings can be changed by the golfer in order to change the drag resistance, as well as imparting varying forces into the arms nd hands of the golfer.

More specifically, the preferred form of the apparatus includes a hollow, metal shaft having a hand grip or handle affixed at one end thereof and an elongated main body attached at the opposite end thereof. The elongated main body has a slot extending longitudinally along opposed sides thereof and parallel to each other and to the axial centerline of the shaft. The slot is dovetailed and slidably receives a plurality of complementary configured wing roots therein.

The wings have a span of at least several inches and therefore extend from the wing root for several inches from the axial centerline of the elongated main body. The wings can be individually inserted in a sequential manner into the slot and slidably removed therefrom.

An odd number of wings can be mounted on opposed sides of the main body to change the configuration of the drag device, and thereby impart different physical characteristics into the golfer's swing, including an imbalanced configuration. The wings can be made of different colors whereby video recordings of the golfer provides a training aid by which his swing can be analyzed and improved.

Accordingly, a primary object of the present invention is the provision of apparatus by which a golfer can exercise while practicing his swing of a golf club.

Another object of the invention is to provide an apparatus for practicing golf comprising a simulated golf club having a handle at the near end thereof and a variable drag device at the far end thereof.

A further object of this invention is to disclose and provide a teaching aide by which a golfer's swing is improved, comprising a simulated golf club having a variable drag device at the distal end thereof by which the golfer's manipulation and position can be studied while he swings the practice golf club device.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described herein.

DETAILED DESCRIPTION OF THE PREFERRED EMBODIMENT

Figures 1, 2, 3, 4, 5, 6:
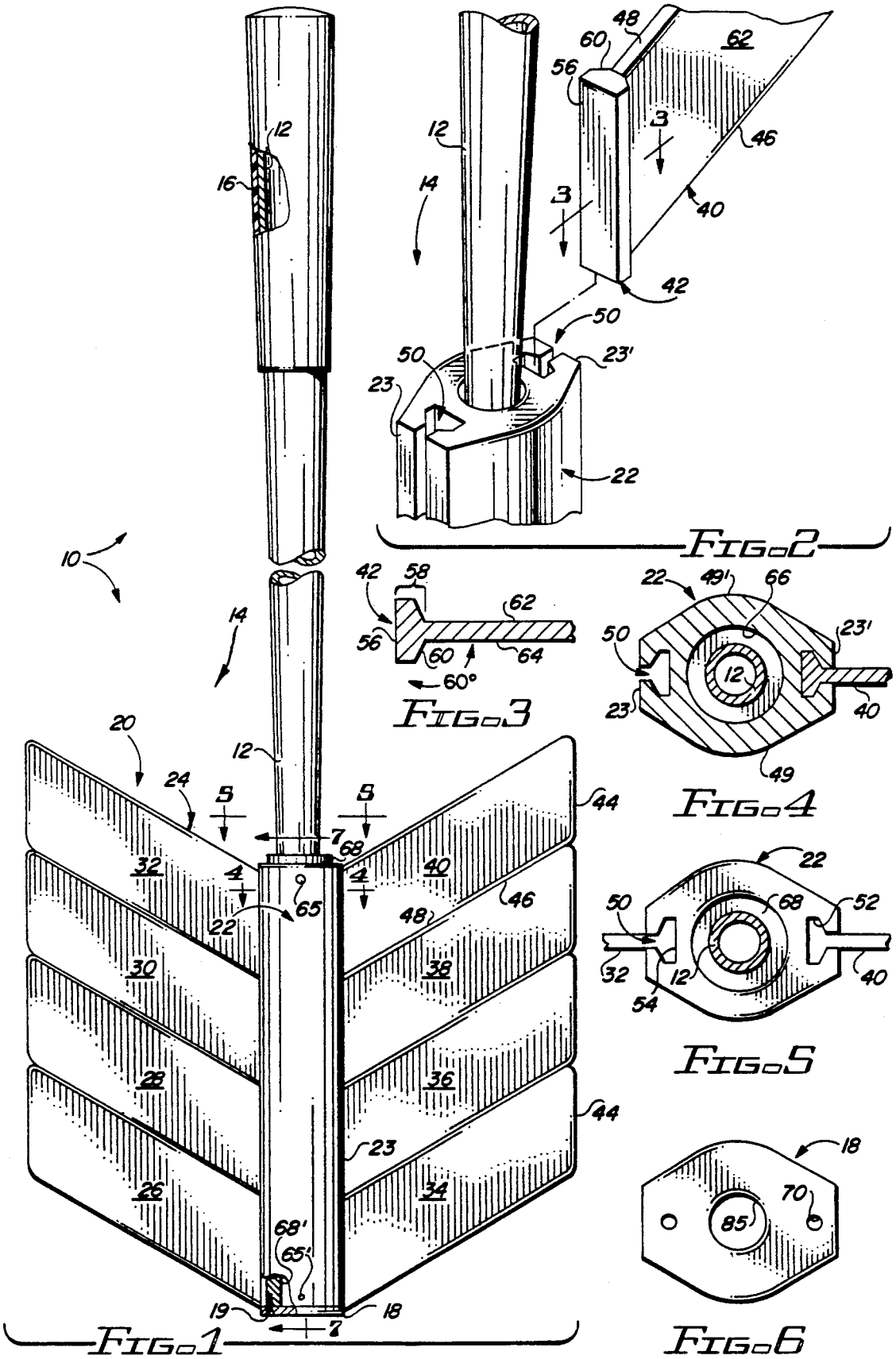
FIG. 1 is an elevational view of a golf practice apparatus made in accordance with the present invention, with some parts being broken away therefrom and some of the remaining parts being shown in cross-section.
FIG. 2 is an enlarged, broken, disassembled view of part of the apparatus disclosed in FIG. 1.
FIG. 3 is a fragmentary, cross-sectional view taken along line 3—3 of FIG. 2.
FIG. 4 is an enlarged, fragmentary, lateral, cross-sectional view taken along line 4—4 of FIG. 1.
FIG. 5 is an enlarged, fragmentary, part cross-sectional view taken along lines 5—5 of the apparatus disclosed in FIG. 1.
FIG. 6 is an enlarged end view of part of the apparatus disclosed in FIG. 1.

FIGS. 1–10 of the drawings disclose a golf practice apparatus 10 having a hollow, golf club shaft 12. As seen in FIG. 1, together with other figures of the drawing, shaft 12 has a high drag variable force apparatus 14 attached to a far end thereof, and a golf club handle or grip 16 affixed to a near end thereof. A removable stop plate 18 is located at the terminal end of golf practice apparatus 10 and is attached by the illustrated screws 19. The practice apparatus 10 includes a wing assembly 20 attached to an elongated main body 22. The wing assembly 20 includes a plurality of wings 24 that are removably attached on either side of the main body 22.

The plurality of wings 24 includes the illustrated individual wings 26, 28, 30 and 32, each of which are removably mounted on the left side of main body 22, and wings 34, 36, 38 and 40 that are removably mounted on the right side of main body 22. As seen in FIGS. 2–5, each wing terminates in a wing root attachment fitting 42 that is in the form of an enlargement located at the root end thereof, which is opposed to a wing tip 44 located at the free end thereof. The wing has a leading edge 46 spaced from a trailing edge 48 thereof to define the width or chord of the wing.

As best seen in FIGS. 2, 4 and 5, together with other figures of the drawings, the main body 22 includes an elongated, dove-tailed, longitudinally extending slot 50 located along both sides of the opposed edges thereof, and is formed by interior surfaces 52 and 54. The dove-tailed slots 50 are made complementary respective to the dove-tailed enlargement that forms the wing root attachment fitting 42.

As seen in FIG. 3, each wing root terminates in an end wall 56. The wing root converges at 60 into the wing upper and lower surfaces 62 and 64. Numeral 58 indicates one of the dimensions of the wing root attachment fitting. The force of wind resistance is transferred by the wing-root attachment fitting into the female, dove-tailed slots 50 of the main body 22. The wing root attachment fitting 42 is slidably received within the coacting female slot 50.

As seen in FIGS. 1, 4 and 5, annular bushings 68 and 68' are interposed in concentric relationship between shaft 12 and main body 22 to support the opposed ends of main body 22 in fixed relationship respective to hollow shaft 12. Bushings 68 and 68' preferably are made of plastic or plastic-like material. Each wing 26-40 may be slidably removed from the appropriate slot 50 of main body 22. One edge of the wing root fitting abuts stop plate 18 which forms a closure member or abutment at the end of slot 50. The wings are slidably removed from slot 50 in a direction towards the handle and away from the stop plate member.

Figure 8:
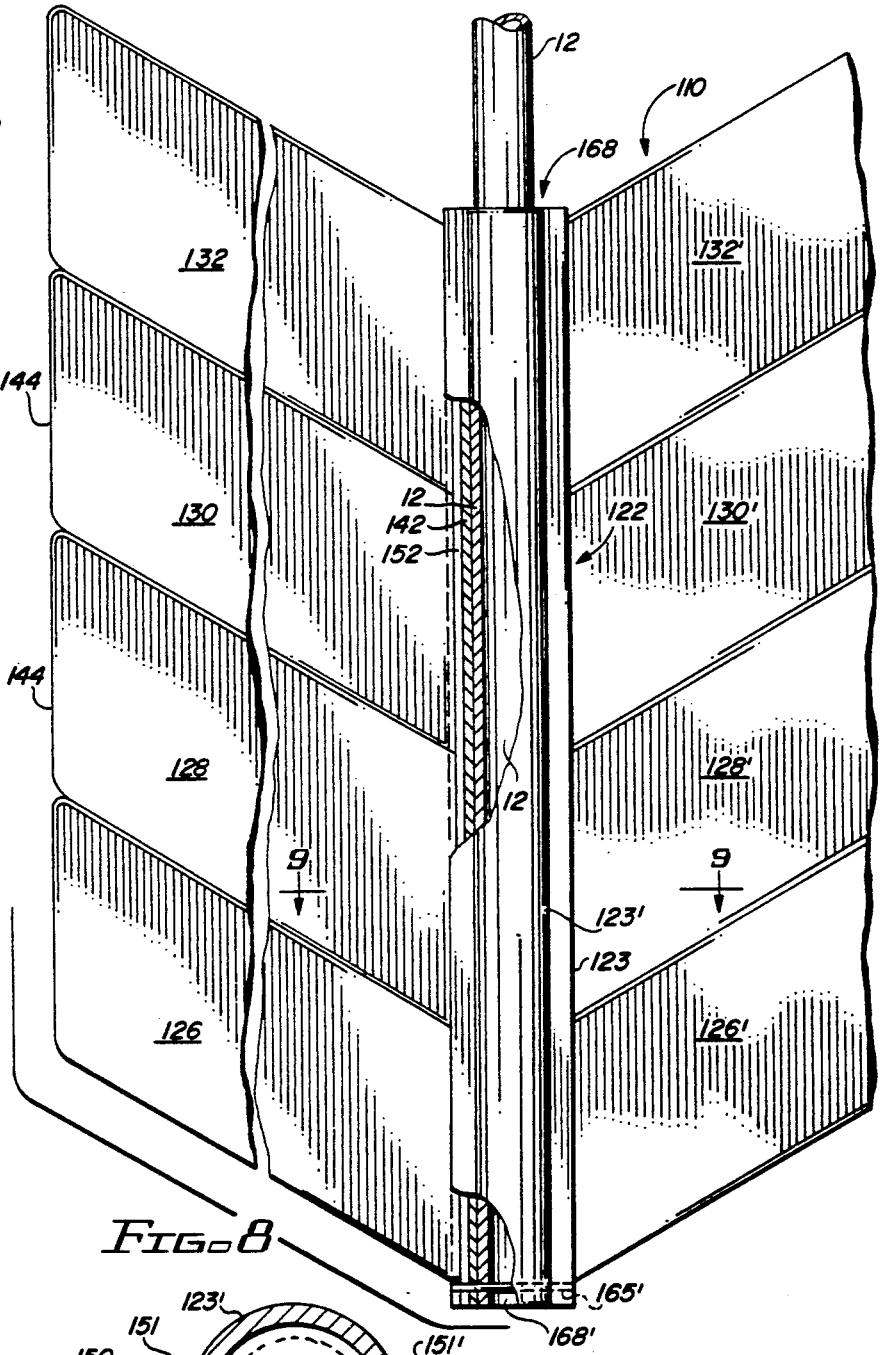
FIG. 8 is a fragmentary, plan view of an alternate embodiment of this invention, with some parts thereof being broken away therefrom and some of the remaining parts being shown in cross-section.
Figure 9:
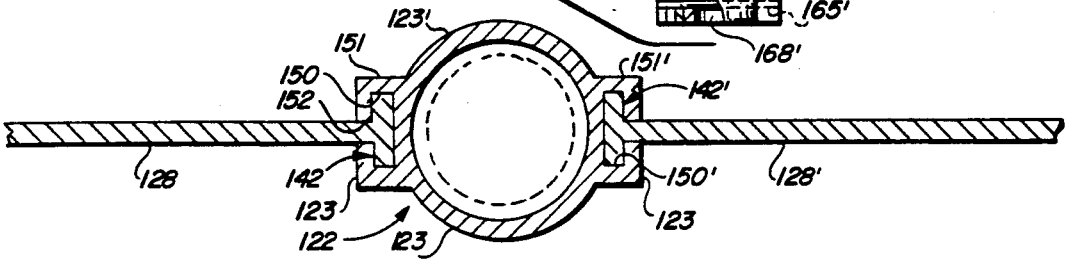
FIG. 9 is an enlarged, broken, cross-sectional view taken along line 9—9 of FIG. 8.
Figure 11:
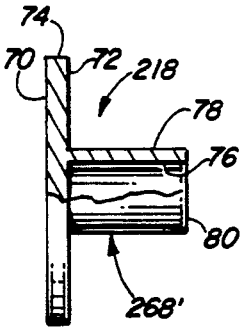
FIG. 11 is a detailed cross-sectional view of part of the apparatus of FIG. 10.
Figure 12:
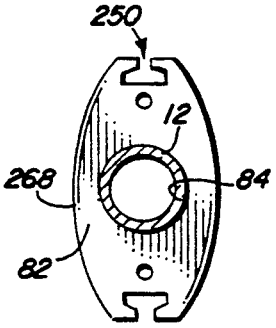
FIG. 12 is a cross-sectional view taken along lines 12—12 of FIG. 10.

In the second embodiment of golf practice apparatus 110 of the invention set forth in FIGS. 8 and 9, main body 122 includes opposed surfaces 123, 123' which diverge at 151, 151' to form dove-tailed or T-slot openings 150, 150' that receive the wing root fitting 142, 142' therein. The dove-tailed or T-slot openings 150, 150 ∝ outwardly open to accommodate the wing chord being slidably received therein in a removable manner.

Wings 126, 128, 130 and 132 are arranged in captured relationship on one side of the main body 122 and wings 126', 128', 130' and 132' are arranged on the other side of the main body 122. Two sets of wings are illustrated in FIG. 8, there being a right and left set of wings attached to the main body. Each set of wings has wing roots by which each wing can be removably attached to either of the opposed slots 150, 150'. The slots are in dove-tailed members 151, 151', as best seen in FIGS. 8 and 9.

Figure 7:
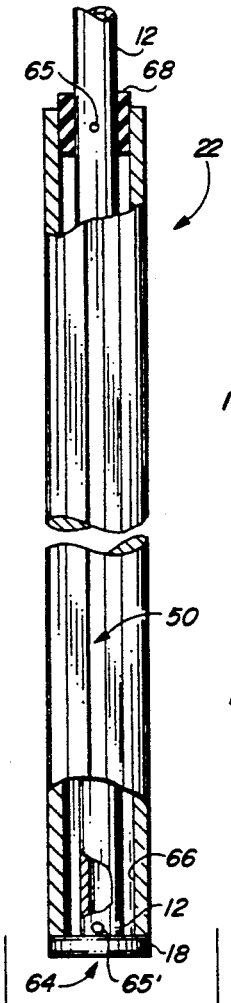
FIG. 7 is a broken, part cross-sectional, plan view taken along line 7—7 of FIG. 1, with some parts thereof being broken away therefrom and some of the remaining parts being shown in cross-section.

In FIG. 8, bushings 168, 168' can be employed to hold main body 122 assembled to shaft 12, and a pin can be used to retain the bushings as illustrated at 65 and 65' in FIGS. 1 and 7. Alternatively, the pin can extend into slots 150, 150' as seen in FIG. 8 at 165' in order to form a stop member to prevent the wing root fittings 142, 142' from sliding out the far end of slots 150, 150'.

In FIG. 9, wings 128 and 128' have an enlarged root fitting 142, 142' in the form of a T which is slidably received within the complementary shaped slot 150, 150' that is formed in the main body.

Often a golfer slices the ball and causes the ball to spin to the right or left as it travels down the fairway. This is undesirable because it always results in significantly reduced travel of the ball, or yardage. When the swing is perfect and the club head strikes the ball squarely, the ball will travel straight down the fairway much further than when sliced. Slicing the ball usually is attributed to the club coming over the ball and not striking the ball true. Use of an apparatus made in accordance with the present invention develops the appropriate arm and shoulder muscles to permit the golfer to assume the ideal posture and to consistently and correctly swing through with the club while rotating the body in a correct manner. The apparatus can be used to advantage during warmup in order to get the appropriate muscles in condition for play, and more importantly, to force the body to bring the proper muscles into play for striking the ball true.

The color of the wings on one side of the main body of the apparatus can be red while the color of the wings on the opposed side can be white, for example, to enable a video study to be conducted of golfers needing improvement in their swing. One or more wings can be removed from either side to imbalance the drag forces and bring the necessary muscles into play until the video study indicates improvement in the swing.

The apparatus can be disassembled and conveniently stored in a golf bag. Various handles or grips 16 can be placed on shaft 12, including ordinary golf grips, memory grips, and other commercially available grips. Lightweight metal shafts weighing only 4.7 ounces are available. Different sizes of the practice apparatus can be fabricated to suitably accommodate children, small people, women, and men, and it is anticipated that only six different models will accommodate all golfers.

SWING SELECTION CHART

| | Wind Velocity = Miles Per Hour | |
|---|---|---|
| Number of Wings: | M.P.H. | Wind Resistance Force (Pounds) |
| 2 | 65 | 3.95 |
| | 85 | 6.75 |
| | 110 | 11.30 |
| 4 | 65 | 7.9 |
| | 85 | 13.50 |
| | 110 | 22.60 |
| 6 | 65 | 11.85 |

-continued

| SWING SELECTION CHART | | |
|---|---|---|
| | Wind Velocity = Miles Per Hour | |
| Number of Wings: | M.P.H. | Wind Resistance Force (Pounds) |
| | 85 | 20.25 |
| | 110 | 33.90 |
| 8 | 65 | 15.80 |
| | 85 | 27.00 |
| | 110 | 45.20 |

The above chart sets forth the range of forces involved when a golfer swings one of the practice devices of the present invention at the indicated velocity.

Figure 10:
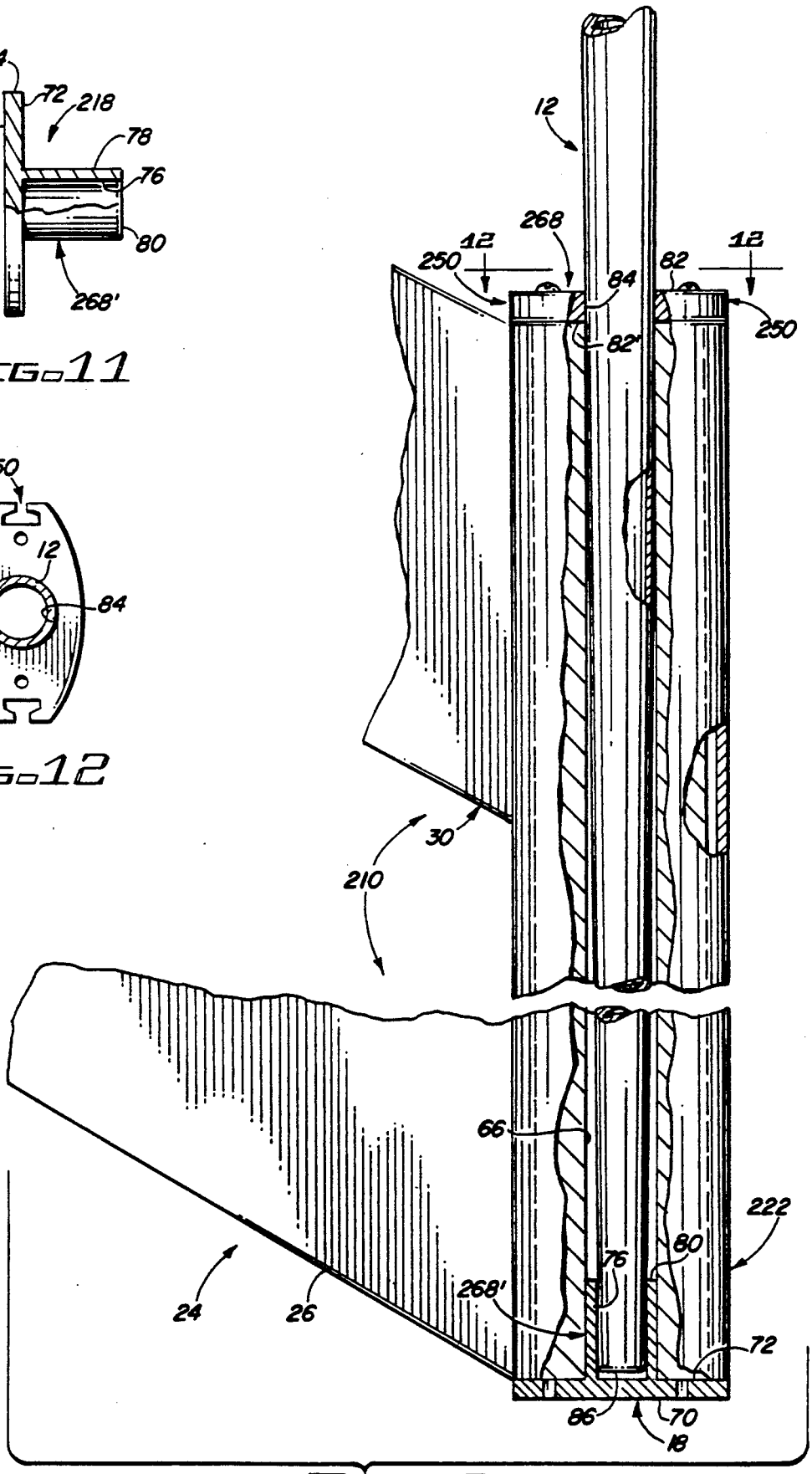
FIG. 10 is a broken, part cross-sectional view of another embodiment of this invention.

In FIG. 10, the stop plate member 218 has opposed faces 70, 72. The inner face 72 of the stop plate member 218 abuttingly engages the lower ends of the wing roots of the lowermost opposed wings 26 and 34 at the outer marginal edge 74 of the stop plate member 218*f*. Lower bushing 268' is of annular construction and has an inner surface 76 that is tapered and slidably engages the lower marginal end of shaft 12 and is attached thereto by high friction developed by the coating surfaces or by screws or cementing. Outer surface 78 of bushing 268' slidably engages the internal wall surface 66 of main body 222 and is attached thereto by friction or cementing. The lower bushing 268' terminates at near end 80 that is opposed to face 70.

The upper bushing 268 has opposed faces, 82 and 82', and is centrally apertured to form a close tolerance surface at 84 that receives a medial marginal length of the tapered shaft 12 in close tolerance relationship therewithin. Upper bushing 268 has opposed slots 250 therein made complementary respective to the opposed longitudinally extending main body slots and are a continuation thereof so as to facilitate slidably receiving the wing roots in a removable manner therein.

The end 86 of shaft 12 is mounted within bushing 268' of the stop plate 218, while a medial length of shaft 12 is captured within bushing surface 84 of the upper bushing 268. Face 72 of stop plate 218 can additionally be affixed to main body 222 by any suitable means, such as pins or screws, as seen in FIGS. 1, 6 and 10, or cementing.

The stop plate 218 preferably is made of plastic and has inner surface 76 and outer surface 78 made into a configuration that must be forced into attached relationship with respect to the outer, lower end surface of shaft 12, and inner surface 66 of the main body, and thereby becomes affixed thereto.

I claim:

1. A golf practice and exercise apparatus (10) comprising a shaft (12) having opposed ends with a grip (16) at one end and a variable drag device (14) at the other end;

said variable drag device (14) includes an elongated main body (22) having a central member attached to said shaft and a left side opposed to a right side; the right and left sides extend away from the central member, a wing assembly (20) for the right and left sides; said wing assembly (20) includes a plurality of wings (24); each wing of said plurality of wings (24) terminate in a wing root attachment fitting; each wing has a leading edge spaced from a trailing edge;

a wing root receiving member in the left and right side of the main body made complementary respectively to said wing root attachment fitting (42); each said wing root receiving member extends longitudinally respective to said shaft and removably receives a plurality of wing root attachment fittings therein with the wings of a wing assembly lying in a common plane and the wing root attachment fittings being aligned along a common axis;

whereby, the shaft can be held in a golfer's hands and the practice and exercise apparatus swung as in striking a golf ball with a golf club, whereupon air resistance of the drag device imparts a force into the golfer's body to cause the body to assume an improved stance which will be remembered with practice.

2. The apparatus of claim 1 wherein said shaft is hollow and tapered to increase the diameter thereof in a direction toward the handle; said wing root attachment fitting is of a dove-tailed male configuration; and, said wing root receiving member is an elongated female dove-tailed slot made complementary respective to the dove-tailed wing root attachment fitting, said dove-tailed slot slidably receives the wing root attachment fitting therein whereby the number of wing roots in a slot can be selected by sliding the wing root attachment fittings into and from the dove-tailed slot.

3. The apparatus of claim 1 wherein an outwardly opening, longitudinally extending slot is formed in said opposed right and left sides of said main body, said slot has a large inner part that receives said wing root attachment fittings therein and outwardly reduces into an opening through which the wings extend;

said wings each have an enlarged root fitting made complementary respective to the slot so that the wing root attachment fittings can slide within said slot and be captured therewithin; stop means at the end of the slot that is opposed to the handle for abutting the wing root attachment fittings and capturing the wing root attachment fitting within the slot.

4. The apparatus of claim 1 wherein the wing root attachment fitting is dove-tailed, and the wing root receiving member is made complementary respective to the dove-tailed wing root attachment fitting; said wings on either side of said main body are parallel to one another and lay in a common plane; said wings on the right side are swept back respective to the wings on the left side.

5. The apparatus of claim 1 wherein said elongated main body has a central passageway formed therethrough; said shaft is fixed within said central passageway; said wing root receiving member accommodates a plurality of wing root attachment fittings, with said leading edge of one wing abutting said trailing edge of another wing;

said wings on either side of the main body are parallel to one another; said wings on one side are swept back respective to the wings on the other side.

6. The apparatus of claim 1 wherein the wing root attachment fitting is dove-tailed and the wing root receiving member is a slot made complementary respective to the dove-tailed wing root attachment fitting; said wings on either side of said elongated main body are parallel to one another; said wings on one side of the main body are swept back respective to the wings on the other side thereof; and stop means at one end of the slot for holding each of the wing root attachment fittings within the appropriate slot.

7. An apparatus by which a golfer can exercise while practicing golf comprising:

an elongated shaft having a near end and a far end, a handle at the near end of the shaft that is adapted to be held by a golfer, a variable drag device at the far end of the shaft for inducing drag thereinto when swung in a manner similar to a golf club;

said drag device includes a main body affixed to the marginal far end of the shaft; a plurality of wings, each wing terminates in a wing root by which the wing is removably affixed to said main body with said wing extending laterally from said main body;

said main body has opposed sides extending from a central member thereof; a wing root receiving member in the opposed sides of said main body made complementary respectively to said wing root; each said wing root receiving member extends longitudinally of the shaft and receives a plurality of wing roots therein with the wings laying in a common plane;

said wings are positioned respective to the handle whereby, when the handle is held and the shaft swung, the variable drag device creates wind resistance and forces the golfer to exert himself in a manner to teach proper stance and procedure.

8. The apparatus of claim 7 wherein said shaft is hollow and tapered to increase the diameter thereof in a direction toward the handle; said wing root is in the form of a dove-tailed attachment fitting and the wing root receiving members of the main body are made complementary respective to the dove-tailed wing root attachment fitting; said wings can be removed from said slot by sliding the wing root attachment fitting from the slot of the main body;

said wings on either side of said main body are parallel to one another; said wings on one side of the main body are swept back toward the handle respective to the wings on the other side thereof; said wings on either side of said main body lay in a common plane.

9. The apparatus of claim 7 wherein an outwardly opening, longitudinally extending slot is formed in said opposed longitudinally extending members of said main body, said slot has a large inner part that reduces outwardly into the opening;

each said wing root is made complementary respective to the slot so that a plurality of the wing roots can slide into and out of said slot and be captured in abutting relationship therewithin; stop means at the end of the slot that is opposed to the handle for abutting the leading edge of a wing root and slidably capturing the wing root within the slot.

10. The apparatus of claim 9 wherein the wing root has a fitting that is dove-tailed and the slot is made complementary respective to the dove-tailed wing root fitting; the wings on either side of the main body are parallel to one another and lay in a common plane; the wings on one side of the main body are swept back respective to the wings on the other side thereof.

11. The apparatus of claim 7 wherein said main body of said variable drag device is elongated and has a central passageway formed therethrough, said opposed sides terminate in longitudinally extending edges spaced from and parallel to said central passageway; means by which said shaft is fixed within said central passageway; said wing root receiving member is formed within the opposed sides;

whereby; the shaft handle can be held in a golfer's hands and the apparatus swung as if striking a golf ball, whereupon the wings induce air resistance which causes the golfer's body to assume an improved stance which will be remembered with practice.

12. The apparatus of claim 11 wherein said wing root has an enlargement thereon; said wing root receiving members include opposed members having an outwardly extending slot formed therein made complementary respective to the enlarged wing root; said wings on either side of the main body are parallel to one another; said wings on one side of the main body are swept back respective to the wings on the other side thereof; and stop means at one end of the slot for holding the wing roots within the appropriate slot.

13. A golf practice and exercise apparatus comprising an elongated shaft having opposed ends, means forming a handle at one marginal end thereof and a drag device at the other marginal end; said drag device includes a plurality of wing assemblies, each wing of said wing assemblies having a wing root opposed to a wing tip and a leading edge opposed to a trailing edge with the chord of the wing extending between the leading and trailing edges; a wing root attachment fitting at the wing root of each wing;

said drag device includes a main body attached to the shaft and extending along said other marginal end of the shaft, said main body has wing root receiving members extending laterally therefrom; said wing root receiving member is made complementary respective to said wing root attachment fitting;

a plurality of wings having the wing root attachment fittings removably received within each of the wing root receiving members, with the wing tips of said wings extending laterally from said main body.

14. The apparatus of claim 13 wherein said shaft is hollow and tapered to increase the diameter thereof in a direction toward the handle; said wing root attachment fitting is dove-tailed and the main body wing root receiving member is a slot made complementary respective to the dove-tailed wing root attachment fitting; said wing root attachment fittings abut one another and can be removed from said slot by sliding the wing root therefrom.

15. The apparatus of claim 14 wherein said wing root receiving members terminate in edges and are outwardly opening, longitudinally, extending slots that are formed in said opposed longitudinally extending members of said main body, said slot extends through the edges and has a large inner part that reduces into an opening adjacent the edges;

said wing root fittings are made complementary respective to the slot so that the wing root fittings can slide longitudinally into said slot and be captured therewithin; stop means at the end of the slot that is opposed to the handle for abutting the leading edge of a wing root and capturing the wing root fitting within the slot.

16. The apparatus of claim 14 wherein the wing root is dove-tailed and each of the wing receiving members is made complementary respective to the dove-tailed wing root; the wings on either side of the main body are parallel to one another and lay in a common plane; the wings on one side of the main body are swept back respective to the wings on the other side thereof.

17. The apparatus of claim 13 wherein said variable drag device is an elongated body having a central passageway formed therethrough and opposed longitudinally extending edges spaced from and parallel to said central passageway; said shaft is fixed within said central passageway; a plurality of wings attached within said wing root receiving members and extending through said edges;

whereby; the shaft handle can be held in a golfer's hands and the practice device is swung as if striking a golf ball, whereupon air resistance causes the golfer's body to assume an improved stance which will be remembered with practice.

18. The apparatus of claim 17 wherein the slot of said variable drag device is made complementary respective to the dove-tailed wing root; said wings on either side of the wing root receiving members are parallel to one another; said wings on one side of the wing root receiving members are swept back respective to the wings on the other side of the wing root receiving members; and stop means at one end of the slot for holding each of the wing roots within the appropriate slot of the wing root receiving members.

* * * * *